United States Patent [19]

Kojima et al.

[11] Patent Number: 4,766,937

[45] Date of Patent: Aug. 30, 1988

[54] WEFT STORAGE DEVICE

[75] Inventors: Shuichi Kojima; Takao Ishido; Shogo Sasaki, all of Tokyo, Japan

[73] Assignee: Nissan Motor Co., Ltd., Yokohama, Japan

[21] Appl. No.: 772,547

[22] Filed: Sep. 4, 1985

[30] Foreign Application Priority Data

| | | | |
|---|---|---|---|
| Sep. 5, 1984 | [JP] | Japan | 59-184431 |
| Sep. 5, 1984 | [JP] | Japan | 59-184432 |
| Sep. 5, 1984 | [JP] | Japan | 59-133874[U] |
| Sep. 5, 1984 | [JP] | Japan | 59-133873[U] |
| Dec. 6, 1984 | [JP] | Japan | 59-184326[U] |

[51] Int. Cl.[4] ..... D03D 47/36; B65H 51/20

[52] U.S. Cl. ..... 139/452; 242/47.08

[58] Field of Search ..... 139/452, 450, 451, 453; 242/47.01–47.13

[56] References Cited

U.S. PATENT DOCUMENTS

| | | | |
|---|---|---|---|
| 3,194,276 | 7/1965 | Krukonis et al. | 242/47.01 |
| 3,209,558 | 10/1965 | Cargill | 242/47.13 |
| 3,637,149 | 1/1972 | Frei | 242/47.12 |
| 3,747,863 | 7/1973 | Klementz et al. | 242/47.01 |
| 3,749,327 | 7/1973 | Roethke et al. | 242/47.12 |
| 3,831,873 | 8/1974 | Bense | 242/47.01 |
| 3,921,925 | 11/1975 | Sarfati et al. | 242/47.01 |
| 4,012,272 | 3/1977 | Tiner | 242/47.01 |
| 4,132,367 | 1/1979 | Ineson et al. | 242/47.01 |
| 4,369,818 | 1/1983 | Yoshida | 139/452 |
| 4,407,336 | 10/1983 | Steiner | 139/452 |
| 4,498,637 | 2/1985 | Yamamoto et al. | 242/18.1 |
| 4,498,639 | 2/1985 | Deborde et al. | 139/452 |
| 4,516,611 | 5/1985 | Mimura et al. | 139/452 |
| 4,550,754 | 11/1985 | Iida | 139/452 |

FOREIGN PATENT DOCUMENTS 55-49177 10/1980 Japan .

*Primary Examiner*—Harvey C. Hornsby
*Assistant Examiner*—Joseph S. Machuga
*Attorney, Agent, or Firm*—Foley & Lardner, Schwartz, Jeffery, Schwaab, Mack, Blumenthal & Evans

[57] ABSTRACT

An air jet loom is equipped with a weft storage device for detaining a weft yarn prior to weft picking through a weft inserting nozzle. The weft storag device includes a roller reel on which the weft yarn is wound in the shape of a coil. The roller reel consists of a plurality of rollers arranged in the shape of a reel in which the axis of each rollers is outside any of planes containing an axis of the roller reel. Some of the rollers are driven around their axis. An engaging member is movably disposed in the vicinity of the unwinding end section of the roller reel and normally engaged with the weft yarn but disengaged from the weft yarn during weft picking, thereby sharply reducing weft picking resistance applied the weft yarn to be picked into the shed of warp yarns.

33 Claims, 11 Drawing Sheets

WEFT STORAGE DEVICE

BACKGROUND OF THE INVENTION

1. Field of the Invention

This invention relates to an improvement in a fluid jet loom in which a weft yarn is picked under the influence of fluid jet, and more particularly to a method for detaining the weft yarn prior to weft picking and a weft detaining device for accomplishing the method.

2. Description of the Prior Art

A variety of weft storage methods and devices have hitherto proposed to accomplish effective weft detaining prior to weft picking. One of these is disclosed, for example, in Japanese Patent Publication No. 55-49177 and arranged to detain a weft yarn between a weft package and a weft inserting device. This weft storage device consists of a plurality of rollers arranged in the shape of a reel or swift to form a roller reel on which the weft yarn is wound in the shape of a coil. The axis of at least a part of rollers is not contained in any of planes containing the axis of the roller reel and is parallel with one of the planes. Accordingly, the weft yarn is fed to the winding end section of the roller reel so as to form a continuous coil of the weft yarn there, and the thus formed weft yarn coil is advanced to the unwinding end section of the roller reel by virtue of the rotation and the inclination of the rollers. Thereafter, the coiled weft yarn is wound off from the unwinding end section of the roller reel and drawn in the shape of balloon upon undergoing a rotation resistance, for example, by means of a brush like member installed at the unwinding end section.

With this conventional configuration, the coiled weft yarn wound on the roller reel can be advanced at a constant speed toward the unwinding end section of the roller reel by virtue of the inclination and the rotation of each roller of the roller reel, and therefore the successively coiled weft yarn is prevented from running on the previously coiled weft yarn while avoiding contact with each other. This prevents entanglement and damage of the weft yarn, and an increase in unwinding resistance of the weft yarn due to running-on of the weft yarn, thereby enabling an orderly weft storage prior to the weft picking.

However, the following drawback has encountered in such a conventional configuration. That is to say, the weft yarn is detained or wound on the roller reel upon undergoing a rotational resistance at the unwinding end section of the roller reel, and drawn in the balloon shape upon undergoing a rotational resistance even during weft picking. Thus, the weft yarn always undergoes a rotational resistance in an amount by which an excessive length of the weft yarn cannot be drawn under inertia at a termination period of the weft picking. This rotational resistance will cause mispick in case of a fluid jet loom particularly in case of an air jet loom in which weft picking force is relatively weak.

SUMMARY OF THE INVENTION

A fluid jet loom is equipped with a weft storage device of the present invention disposed between a weft supply device and an weft inserting nozzle. The weft storage device includes a roller reel on which the weft yarn is wound in a coil shape prior to introduction to the weft inserting nozzle. The roller reel consists of a plurality of rollers arranged to be nearly circular and parallel with each other in which the axis of at least one of the rollers is outside any of planes containing an axis of the roller reel. The at least one roller of the roller reel is driven to rotate around its axis. Additionally, an engaging member is movably disposed in the vicinity of the unwinding end section of the roller reel and arranged to be normally engaged with the weft yarn to prevent the weft yarn from its movement toward the weft inserting nozzle. The engaging member is driven to release the engagement with the weft yarn during weft picking.

Consequently, the unwinding operation of the weft yarn from the roller reel is carried out during weft picking upon disengagement of the engaging member with the weft yarn, thus sharply reducing weft picking resistance applied to the picked weft yarn. This effectively prevents mispick due to a greater weft picking resistance, so that the weft storage device is suitable particularly to air jet looms whose weft picking force is relatively low. Furthermore, the movement of the weft yarn is stopped upon engagement with the engaging member, and therefore the weft yarn can be prevented from being excessively drawn from the roller reel even when the picked weft yarn is suddenly stopped at the termination of the weft picking.

BRIEF DESCRIPTION OF THE DRAWINGS

The features and advantages of the weft storage device according to the present invention will be appreciated from the following description taken in conjunction with the accompanying drawings in which same reference numerals designate corresponding elements and parts throughout all the drawings, in which.

DETAILED DESCRIPTION OF THE INVENTION

Figure 1:
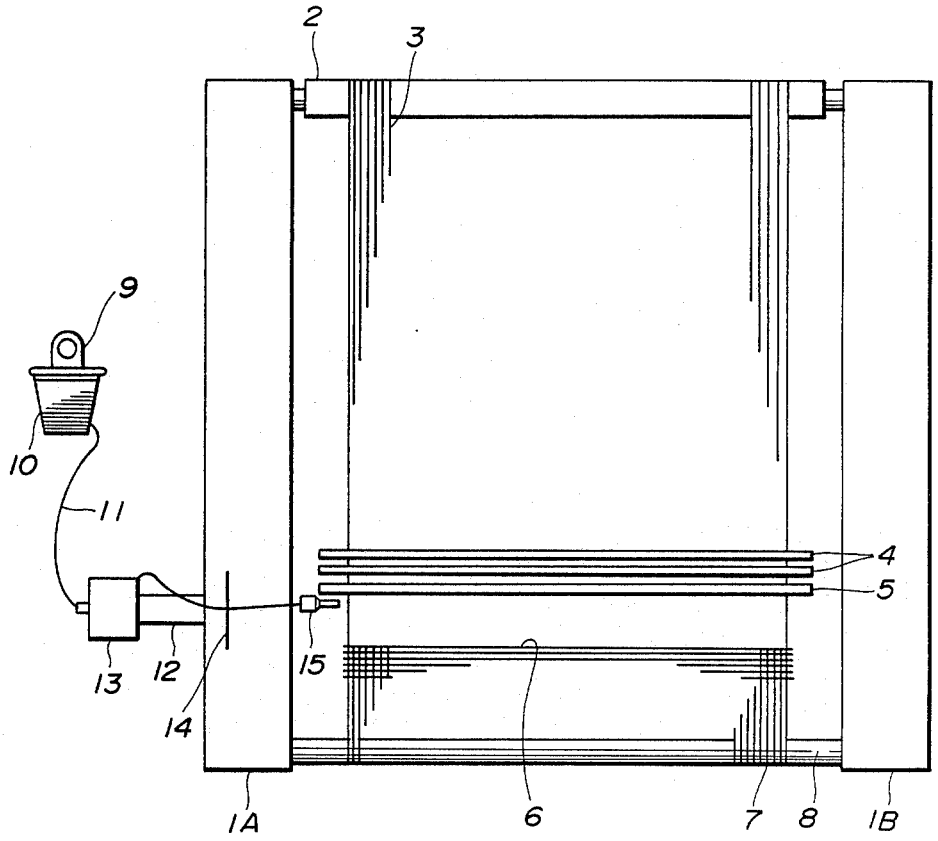
FIG. 1 is a plan view of a fluid jet loom equipped with a weft storage device according to the present invention.

Referring now to FIG. 1, there is shown a fluid (air) jet loom equipped with a weft storage device 13 of the present invention. The loom consists of frames 1A, 1B on which a back roller 2 is rotatably supported. Warp yarns 3 are being passed on the back roller 2 and extend through healds 4 and a reed 5 forming a cloth fell 6 from which a woven cloth 7 extends through a breast beam 8 to a take-up motion (not shown). A weft package 10 is supported by a package stand 9. A weft yarn 11 drawn from the weft package 10 is fed to the weft storage device 13 supported by a bracket 12 fixed to the frame 1A. The weft yarn 11 from the weft storage device 13 is introduced to a weft inserting nozzle 15 through a weft guide 14 disposed on the frame 1A. The weft inserting nozzle 15 is swingably moved together with the reed 5. Thus, the weft yarn 11 stored in the weft storage device 13 is picked to the shed of the warp yarns 3 under the influence of air jet ejected from the weft inserting nozzle 15, and thereafter beaten up by the reed 5 to weave the cloth 7.

A first embodiment of the weft storage device 13 will be discussed hereinafter with reference to FIGS. 2 to 4.

The weft storage device 13 consists of a support body 20 fixed to the bracket 12 on which body a rotatable shaft 22 is rotatably supported through a bearing 21. A variable speed type electric motor 23 is fixed to the support body 20 at an end face on the side of the weft package 10 (on the left-hand side in FIG. 2) in order to drive the rotatable shaft 22 to rotate. The motor 23 may not be of the variable speed type and is sufficient to be of the type wherein an amount of the weft yarn 11 drawn from the weft package 10 is larger than that of the consumed or picked weft yarn 11. However, it is preferable to be of the variable speed type because the revolution speed of the motor can be set at an optimum level for the consumed or picked weft yarn.

The rotatable shaft 22 is formed at a part on the side of the weft package 10 with a yarn introduction bore 24 and provided at its central part part with a winder pipe 25 which is in communication with the yarn introduction bore 24. The winder pipe 25 is secured in position by means of a small screw 26 and projects diagonally to the side of the weft inserting nozzle 15. The winder pipe 25 is provided at its tip section with a winding guide 27 through which the weft yarn 11 is guided. The rotatable shaft 22 is provided at the central part also with a balancing rod 28 which is located generally symmetrical with the winder pipe 25 and secured in position by means of a nut 29.

Figure 2:
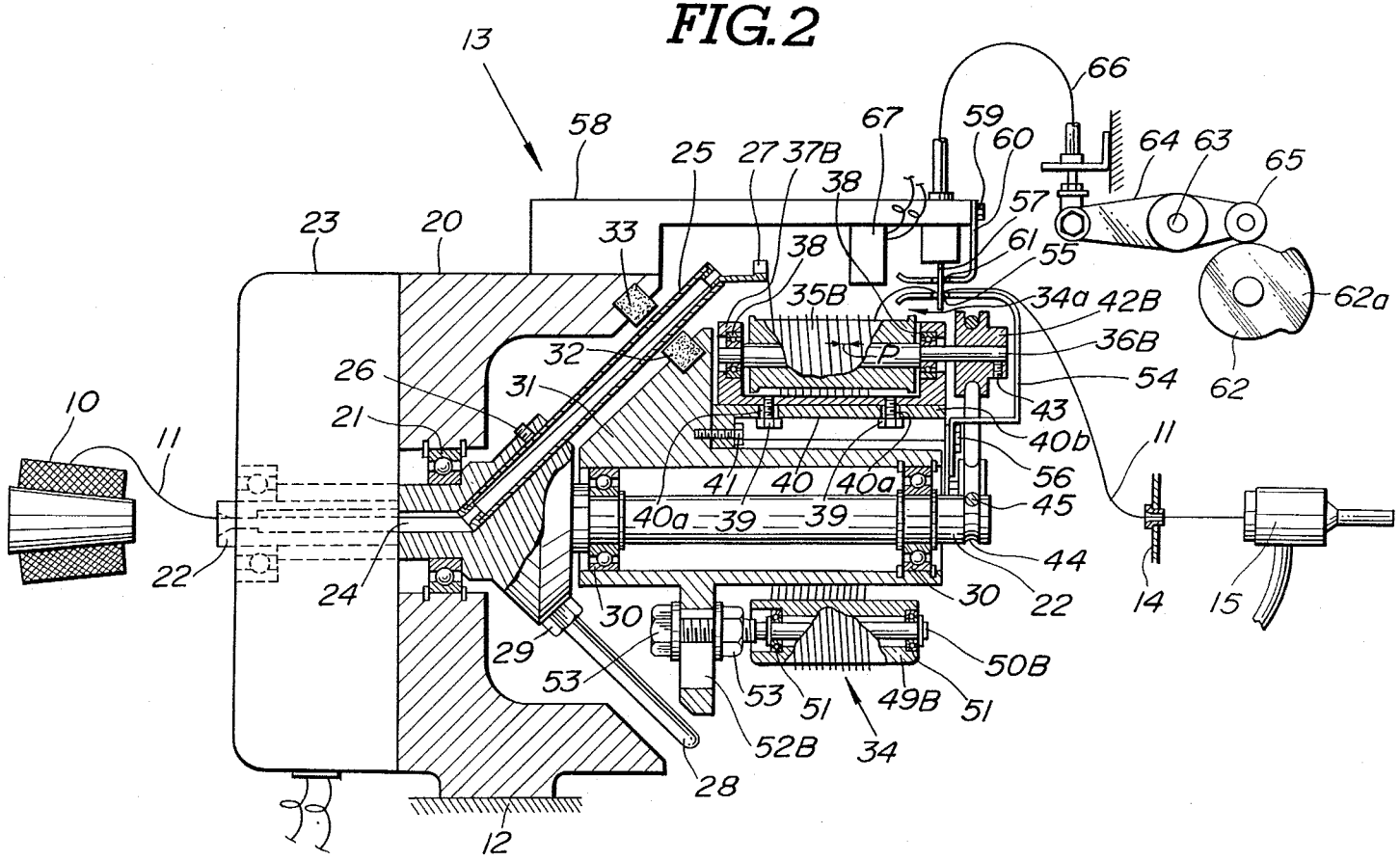
FIG. 2 is a front vertical sectional view of a first embodiment of the weft storage device of the present invention.

A flanged cylindrical stationary support body 31 is relatively rotatably mounted through bearings 30 on the rotatable shaft 22 at a part on the side of the weft inserting nozzle 15 (or on the right-hand side in FIG. 2). The stationary support body 31 is securely provided with a permanent magnet 32 which faces a permanent magnet 33 maintaining a predetermined distance therebetween. The magnet 33 is secured to the support body 20 so that the stationary support body 31 remains stationary even upon rotation of the rotatable shaft 22 under the attraction between the magnets 32, 33. It will be understood that the winder pipe 25 will pass a space between the magnets 32, 33 when rotates around the axis of the rotatable shaft 22.

The stationary support body 31 is provided with three drive rollers 35A, 35B, 35C and three follower rollers 49A, 49B, 49C which are arranged in the reel or swift shape. The drive rollers 35A, 35B, 35C have respective spindles 36A, 36B, 36C which are respectively rotatably supported through bearings 38 by support frames 37A, 37B, 37C. These support frames 37A, 37B, 37C are fixed to a bracket 40 by means of bolts 39, which bracket is fixed to the stationary support body 31 by means of bolts 41. Each bolt 39 is disposed to pass through a through-hole 40*a* formed in the bracket 40. A pulley 42A, 42B, 42C is fixed to an projected end section of each spindle 36A, 36B, 36C by means of a small screw 43. A belt 45 having a circular cross-section is passed on the pulleys 42A, 42B, 42C and on a pulley 44 provided at one end of the rotatable shaft 22. Additionally, the belt 45 is passed also on guide rollers 46A, 46B which are installed to brackets 48A, 48B which are fixed to the bracket 40. Accordingly, the drive rollers 35A, 35B, 35C rotate in the same direction around the respective spindles upon rotation of the rotatable shaft 22. Thus, the rotatable shaft 22, the belt 45, and the pulleys 42A, 42B, 42C constitute a rotational drive mechanism. It is to be noted that the drive rollers 35A, 35B, 35C are such arranged that the axis of each spindle 36A, 36B, 36C of them is not contained in any of planes containing the axis of the rotatable shaft 22 and is parallel with one of these planes. This arrangement is realized by installing the support frames 37A, 37B, 37C in such a manner as to be inclined in the same direction relative to the bracket 40 or to the axis of the rotatable shaft 22.

The follower rollers 49A, 49B, 49C are rotatably mounted through bearings 51 on respective support spindles 50A, 50B, 50C. These support spindles 50A, 50B, 50C are passed at their one end section through respective adjustment holes 52A, 52B, 52C each of which elongates radially relative to the axis of the rotatable shaft 22, in which the one end section of each support spindle 50A, 50B, 50C is fixed in position upon tightening a lock nut 53. Thus, the adjustment holes 52A, 52B, 52C, the lock nuts 53 and the like constitute a follower roller position adjustment mechanism. It is to be noted that these support spindles 50A, 50B, 50C are slightly bent at a section in the vicinity of the one end section thereof in such a manner that the axis of each follower roller 49A, 49B, 49C is not contained in any of the planes containing the axis of the rotatable shaft 22 and is parallel with one of these planes. Additionally, the axis of each follower roller 49A, 49B, 49C is inclined in the same direction and at the same angle relative to the axis of the rotatable shaft 22 as the axis of each drive roller spindle 36A, 36B, 36C. Thus, the drive rollers 35A, 35B, 35C and the follower rollers 49A, 49B, 49C are arranged in the reel or swift shape and to be inclined in such a manner that the axes of them are not contained in or outside any of the planes containing the axis of the rotatable shaft 22 serving as a reel axis and are parallel with one of these planes, thereby constituting a roller reel or frame 34.

A cover 54 having a through-hole 55 is disposed in such a manner as to cover the drive rollers 35A, 35B, 35C, and its stay section is fixed to a bracket 40 by means of a bolt 56. A rod-like engaging member 57 is movably supported by a bracket 58 fixed to the support body 20 and located to face the outer surface of the cover 54. This engaging member 57 is normally in a state to pass through a through-hole 61 of a cover 60 fixed to the bracket 58 by a bolt 59 and is further inserted into the through-hole 55 of the cover 54, thus engaging with the weft yarn 11 located between the covers 54, 60 and extended from the unwinding end section **34*a* of the roller reel 34 to the weft inserting nozzle 15**.

A cam 62 is provided to be rotated in timed relation to a main shaft (not shown) of the loom. Contacted with the cam 62 is a cam follower 65 pivotally attached to a lever 64 which is rotatably mounted on a fixed spindle 63. During weft picking, the cam lobe **62*a* of the cam 62 is brought into contact with the cam follower 65 thereby to rotate the lever 64 counterclockwise in FIG. 2, so that the engaging member 57 connected to the lever 64 by a wire 66 is pulled upward in FIG. 2 to be withdrawn from the through-holes 55, 61 of the covers 54, 60**.

Figure 5:
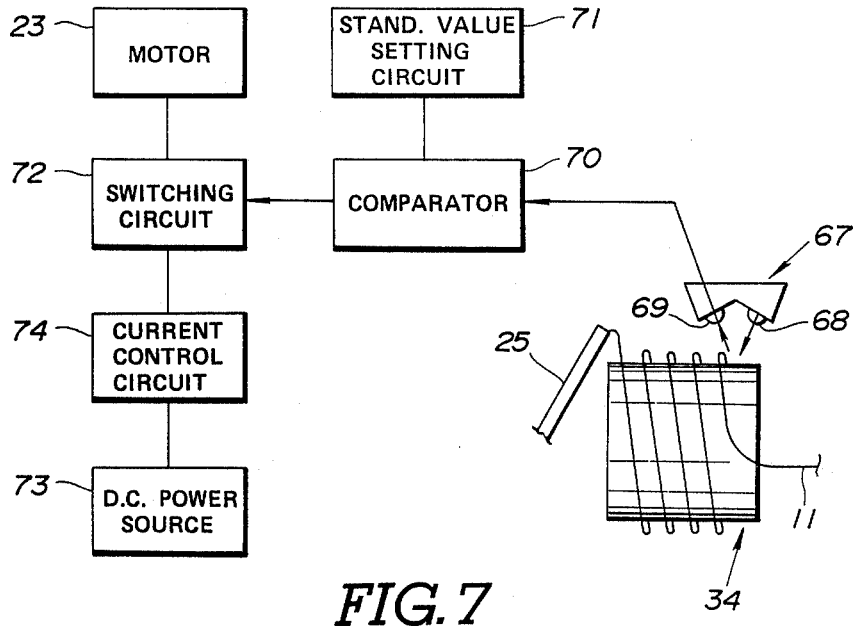
FIG. 5 is a schematic illustration of a control system for a motor used in the weft storage device of FIG. 2.

A photoelectric weft detector 67 is secured to the bracket 58 and located to face the peripheral surface of the drive roller 35B in the vicinity of the unwinding end section **34*a* of the roller reel 34. The weft detector 67 is provided with a light casting device 68 and a light receiving device 69 and forms part of a motor control system as shown in FIG. 5. The motor control system is so arranged as to control the operation of the motor 23 in response to a detected increase in the amount of light reflected by the surface of the drive roller 35B, the reflected light increase being due to the consumption or unwinding of the weft yarn 11 on the roller reel 34**.

The motor control system will be discussed more specifically with reference to FIG. 5. A signal from the light receiving device 69 is supplied to a comparator 70 to be compared with a standard value signal from a standard value setting circuit 71. The output of the comparator becomes of a H level to make a switching circuit 72 conductive (ON) when the signal from the light receiving device 69 is higher than the standard level signal, i.e., the weft yarn 11 on the roller reel 34 has been consumed or wound off thereby to put out light irregular reflection by the weft yarn 11 so that a large amount of light from the light casting device 68 is supplied to the light receiving device 69 upon reflection of light by the exposed peripheral surface of the drive roller 35B. Such a conduction of the switching circuit 72 allows the motor 23 to be electrically connected to a direct current source 73 through an electric current control circuit 74 for control the revolution speed of the motor 23, so that the motor 23 and the rotatable shaft 22 controllably rotate and accordingly the winder pipe 25 rotates around the roller reel 34.

The manner of operation of the first embodiment of the weft storage device 13 will be discussed hereinafter.

Figure 3:
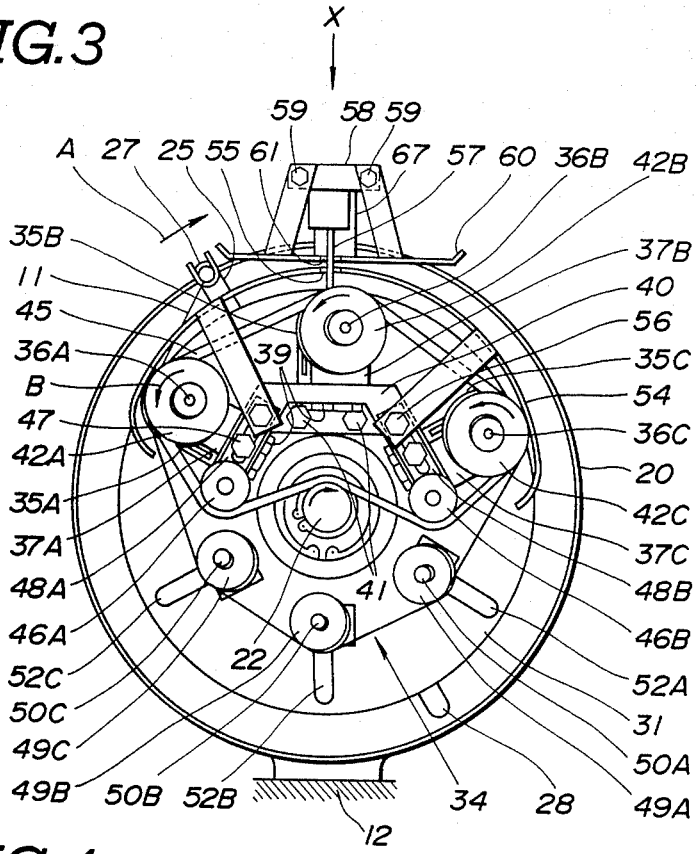
FIG. 3 is a side view of the weft storage device of FIG. 2.

When the motor 23 rotates, the winder pipe 25 rotates in the direction of an arrow A in FIG. 3 together with the rotable shaft 22, so that the weft yarn 11 is wound on the roller reel 34 consisting of the drive rollers 35A, 35B, 35C and the follower rollers 49A, 49B, 49C, in which whole the roller reel 34 is kept stationary even upon rotation of the rotatable shaft 22. The rotation of the rotatable shaft 22 causes the drive rollers 35A, 35B, 35C to rotate in the direction of an arrow B through the belt 45 and the pulleys 42A, 42B, 42C. During such rotation of the drive rollers 35A, 35B, 35C, the weft yarn 11 wound in the coil shape on the peripheral surface of the roller reel 34 is gradually and successively moved to the unwinding end section **34*a* of the roller reel 34 by virtue of the inclination of the rollers 35A, 35B, 35C, 49A, 49B, 49C, so that the thread lines of the coiled weft yarn 11 passed on the rollers are spaced from each other with a distance or winding pitch P as shown in FIG. 2. It will be understood that the distance or winding pitch P between the adjacent thread lines of the coiled weft yarn turned is determined by the inclination and the rotational speed of the rollers 35A, 35B, 35C, 49A, 49B, 49C. Accordingly, this distance P can be changed by changing the inclination of the support frames 37A, 37B, 37C relative to the bracket 40 (or to the axis of rotatable shaft 22), or by replacing the pulleys 42A, 42B, 42C** with those having different diameters.

When the wound weft yarn 11 reaches a location below the weft detector 67, there arises an irregular reflection of light from the light casting device 68 thereby to reduce the amount of light supplied to the light receiving device 69. As a result, the comparator 70 outputs a L level signal thus to make the switching circuit 72 nonconductive (OFF), so that the motor 23 is stopped. This interrupts the weft yarn winding operation.

Meanwhile the engaging member 57 projects into and withdraws from the through-holes 55, 61 of the covers 54, 60 through the lever 64 and the wire 66 under the action of the cam 62 rotated in timed relation to the rotating loom main shaft. This will be explained more specifically with reference to FIG. 6 along with the operation of the weft inserting nozzle 15.

Figure 6:
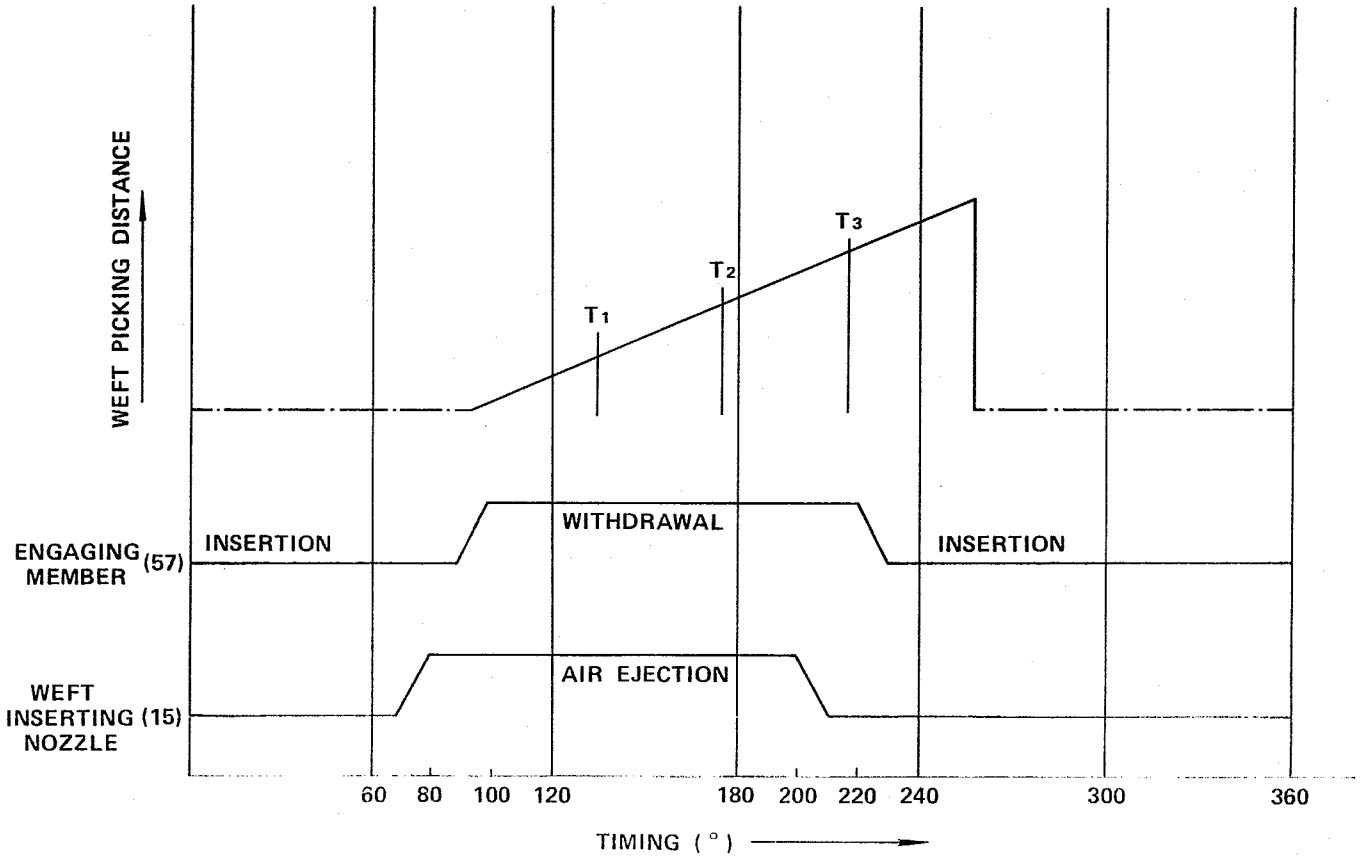
FIG. 6 is a graph showing the operational timings of essential devices of the loom of FIG. 1.

Referring to FIG. 6, an air ejection from the weft inserting nozzle 15 is initiated prior to weft picking, and immediately thereafter the engaging member 57 withdraws from the through-holes 55, 61. As a result, the weft yarn 11 is wound off from the unwinding end section **34*a* of the roller reel 34 under the traction force of air jet from the weft inserting nozzle 15 causing so-called ballooning of the weft yarn 11, thus picking the weft yarn 11 into the shed of the warp yarns 3. It will be understood that the magnitude of the ballooning of the unwinding weft yarn 11 may be controlled by disposing a ballooning cover (not shown) between the roller reel 34 and the weft guide 14. During a weft picking operation, the weft yarn 11 is wound off and drawn turning around the roller reel 34 in which the reaching timings of the thread lines of the weft yarn 11 to the vicinity of the engaging member 57 are indicated at $T_1$, $T_2$, and $T_3$ in FIG. 6**.

Immediately after the third passage ($T_3$) of the weft yarn 11 through the vicinity of the engaging member 57, the engaging member 57 is inserted into the through-holes 55, 61, so that the weft yarn 11 engages with the engaging member 57 thus terminating the weft picking. The air jet ejection from the weft inserting nozzle 15 has been already stopped hereinbefore. As a result of completion of such a weft picking, there has been no weft yarn 11 at the location below the weft detector 67 thereby to enlarge the amount of light to be supplied to the light receiving device 69. Consequently, the comparator 70 makes a discrimination that the light amount exceeds a standard level and therefore makes the switching circuit 72 conductive. Consequently the motor 23 rotates to wind the weft yarn 11 on the roller reel 34 thus maintaining a predetermined amount of the wound weft yarn 11. It is preferable that the speed of the winding the weft yarn 11 is higher than that of consumption or unwinding of the weft yarn 11. In this regard, the electric current control circuit 74 is provided to enable changing the revolution speed of the motor 23.

In order to change the width of the woven cloth 7 or weft picking distance, the nuts 53 of the support spindles 50A, 50B, 50C (or at least one of these) of the follower rollers 49A, 49B, 49C are loosened to move the support spindles within the respective adjustment holes 52A, 52B, 52C and then again fixed in the respective predetermined locations. This changes the circumferential length of the roller reel 34 and accordingly the weft picking distance. In this connection, the circumferential length of the roller reel 34 is adjusted in such a manner that an integer number of unwinding action of the weft yarn 11 is always gotten when the weft yarn engages with the engaging member 57, because the regulation of the weft picking distance is accomplished by the engaging member 57.

Figure 4:
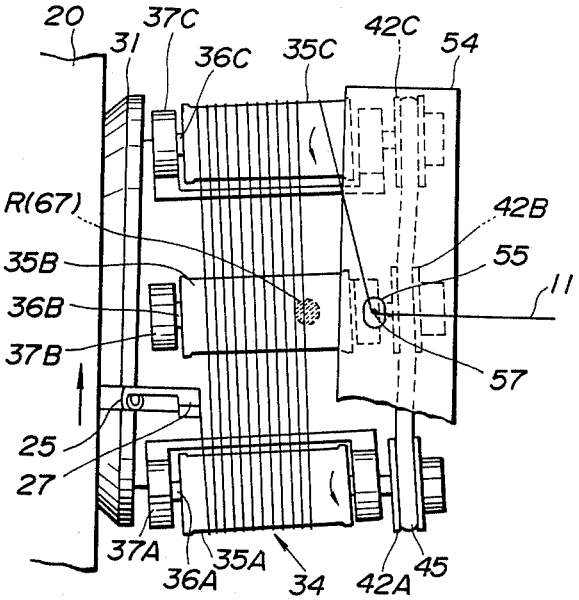
FIG. 4 is a plan view of an essential part of the weft storage device of FIG. 2.
Figure 7:
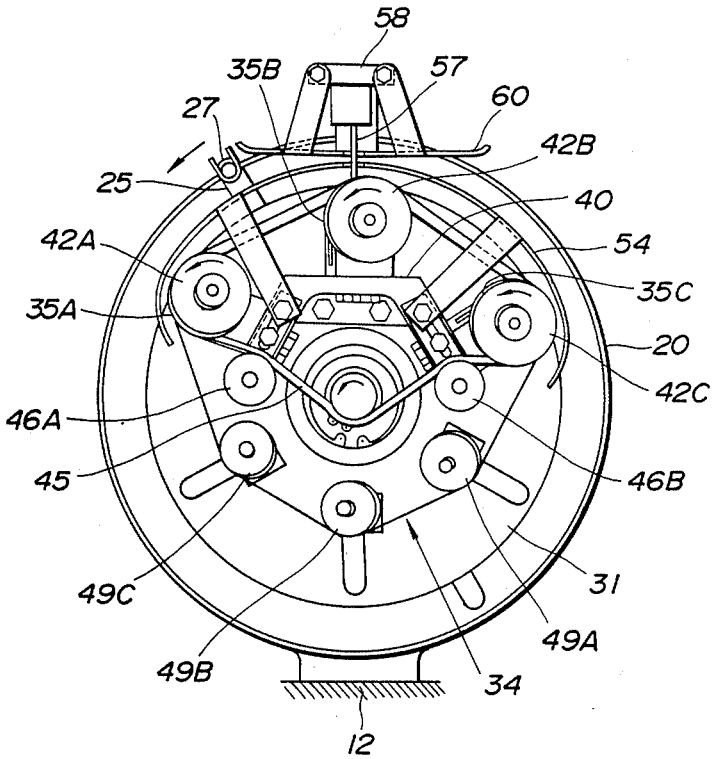
FIG. 7 is a side view similar to FIG. 3 but showing a second embodiment of the weft storage device according to the present invention.

FIG. 7 illustrates a second embodiment of the weft storage device 13 of the present invention which is similar to the embodiment of FIGS. 2, 3 and 4 with the exception that the rotational direction of the rotatable shaft 22 is set to be reverse to that in FIG. 3, and the belt 45 is passed on the lower side of the pulley 44 of the rotatable shaft 22 so that the drive rollers 35A, 35B, 35C rotate in the same direction as in FIG. 3. In connection with the unwinding direction and the winding direction (the rotational direction of the winder pipe 25) of the weft yarn 11, the weft yarn 11 at the time of flight termination is so affected that the tension of the weft yarn 11 is weakened in the case of FIG. 3 while the tension of the weft yarn is increased in the case of FIG. 7. Accordingly, a selection may be made on the two cases of FIGS. 3 and 7 as occasion demands. It will be understood that, even in the case of maintaining the same rotational direction of the rotatable shaft 22 as in the case of FIG. 3, the same effect as the case of FIG. 7 can be obtained also by changing the location at which the belt 45 is passed on the pulley 44 of the rotatable shaft 22 while reversing the inclination direction of the drive rollers 35A, 35B, 35C and the follower rollers 49A, 49B, 49C.

Figure 8:
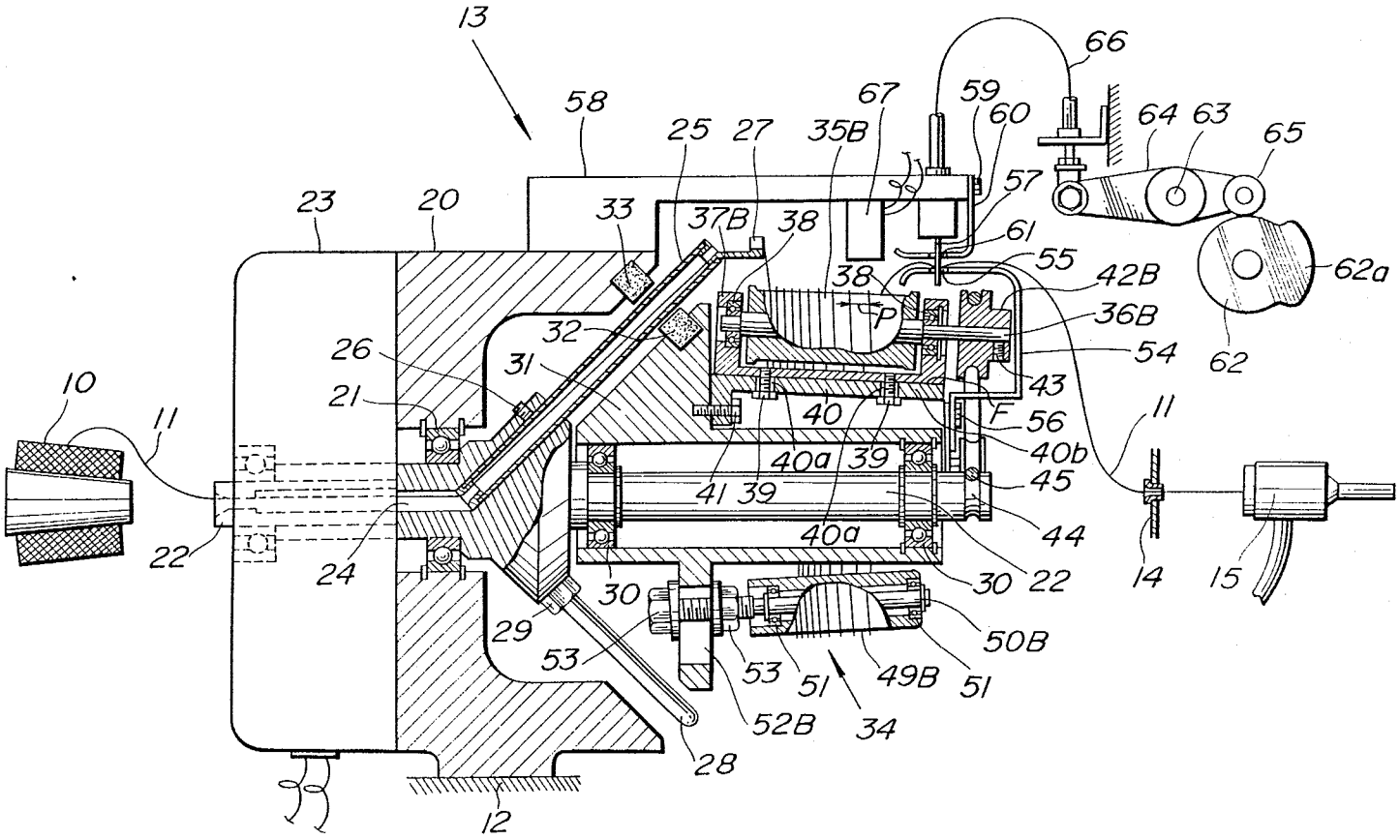
FIG. 8 is a front vertical sectional view similar to FIG. 2 but showing a third embodiment of the weft storage device according to the present invention.
Figure 9:
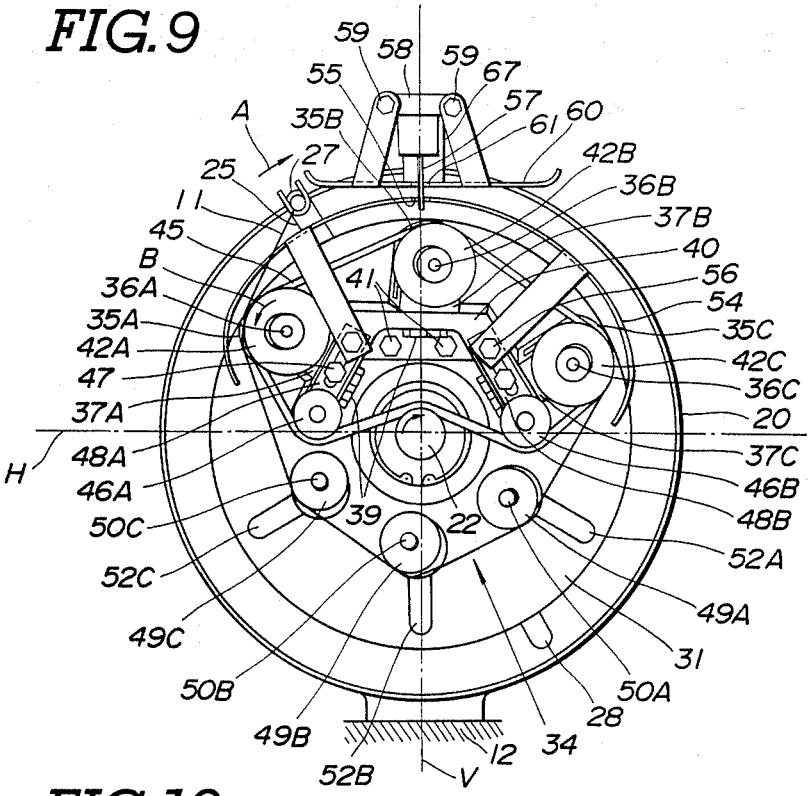
FIG. 9 is a side view of the weft storage device of FIG. 8.

FIGS. 8 and 9 illustrate a third embodiment of the weft storge device 13 of the present invention. In this embodiment, the bracket 40 has a plate section **40*b* extending toward the side of the weft inserting nozzle 15 which plate section is formed with flat faces F on which the support frames 37A, 37B, 37C are contactingly attached. It is to be noted that the plate section 40*b* of the bracket 40 is so shaped that the flat faces F are gradually inclined to be closer to the axis of the rotatable shaft 20 in the direction toward the side of the weft inserting nozzle 15 on a vertical plane V containing the axis of the rotatable shaft 20. Accordingly, the axis of each drive roller 35A, 35B, 35C is inclined to become closer to the axis of the rotatable shaft 22 in the direction toward the side of the weft inserting nozzle 15. Additionally, the follower rollers 49A, 49B, 40C are similarly inclined in such a manner that the axis of them becomes closer to the axis of the rotatable shaft 22 in the direction toward the side of the weft inserting nozzle 15. Thus, the drive rollers 35A, 35B, 35C and the follower rollers 49A, 49B, 49C are arranged in the reel shape to constitute the roller reel 34, in which the axis of each roller does not contained in or outside any of the planes containing the axis of the rotatable shaft 22 and becomes closer to the axis of the rotatable shaft 22 in the direction toward the side of the weft inserting nozzle 15**.

With this arrangement, when the weft yarn 11 is brought into engagement with the engaging member 57 at the time of termination of the weft picking, the weft yarn 11 is pulled to the side of the weft inserting nozzle 15 under the inertia force of flight of the weft yarn 11. At this time, the weft yarn wound in the coil shape on the roller reel 34 successively shifts toward the side of the weft inserting nozzle 15 by virtue of the fact that each of the rollers 35A, 35B, 35C, 49A, 49B, 49C is inclined to be closer to the axis of the rotatable shaft 22 in the direction toward the side of the weft inserting nozzle 15 so that the roller reel is formed as a whole to be tapered in the direction toward the side of the weft inserting nozzle 15. This results in feeding the weft yarn 11 on the rollers to the side of the weft inserting nozzle 15 by an amount obtained by virtue of approaching a yarn winding section (on which the weft yarn is wound) of the roller reel 34 to the side of the weft inserting nozzle 15 and of decreasing the outer circumferential length of the roller reel 34, thereby reducing a tension rise of the weft yarn 11 to prevent weft yarn cutting.

It will be understood that the amount of weft yarn shifting to the side of the weft inserting nozzle 15 becomes larger in the direction toward the side of the weft inserting nozzle 15, i.e., the winding pitch P indicated in FIG. 8 becomes larger in the direction toward the side of the weft inserting nozzle 15. Consequently, although the winding pitch P at the winding initial period is smaller, the winding pitch immediately before the weft picking becomes larger, thus preventing mispick due to entanglement of fluff of the adjacent wound line sections of the weft yarn 11.

Figure 10:
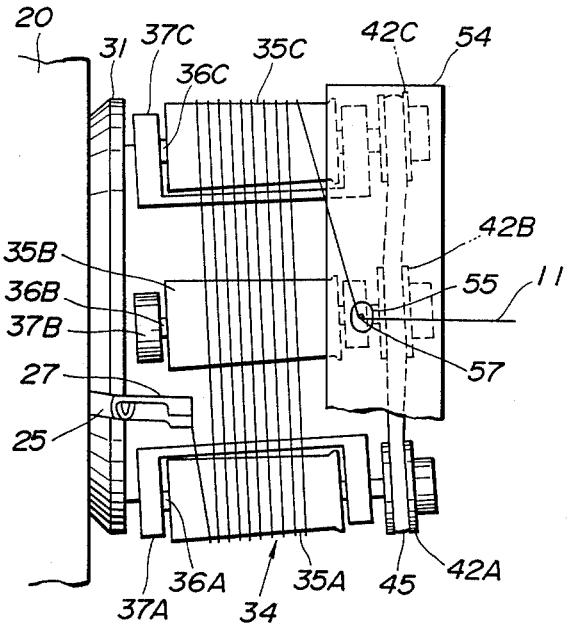
FIG. 10 is a plan view similar to FIG. 4 but showing a fourth embodiment of the weft storage device according to the present invention.
Figure 11:
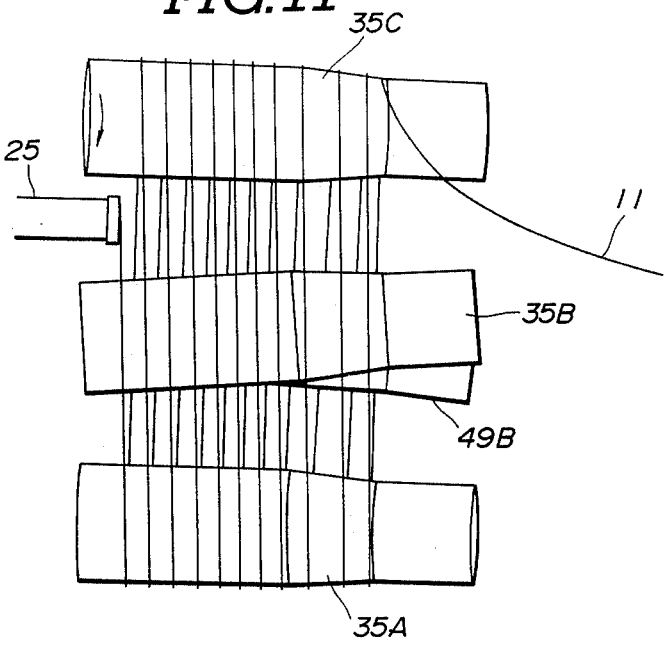
FIG. 11 is a plan view showing an essential part of a modified example of the weft storage device of FIG. 10.

FIG. 10 illustrates a fourth embodiment of the weft storage device 13 of the present invention which is similar to the embodiment of FIGS. 8 and 9 with the exception that each of the rollers 35A, 35B, 35C, 49Am 49B, 49C is not inclined to be closer to the axis of the rotatable shaft 22 in the direction toward the side of the weft inserting nozzle 15. In this embodiment, each of the rollers 35A, 35B, 35C, 49A, 49B, 49C is formed to be tapered toward the side of the weft inserting nozzle 15, so that the roller reel 34 is formed as a whole to be tapered toward the side of the weft inserting nozzle 15. It will be understood that this arrangement offers the same advantageous effect as in the embodiment of FIGS. 8 and 9. Additionally, the same advantageous effect can be obtained by tapering only a part at the side of the weft inserting nozzle 15 of each of the rollers 35A, 35B, 35C, 49A, 49B, 49C as shown in FIG. 11.

It will be understood that each roller 35A, 35B, 35C, 49A, 49B, 49C is formed generally into the beer barrel shape wherein the diameter at the longitudinal central section thereof is the largest and becomes gradually smaller in the direction toward the opposite ends, so that the outer circumferential length of whole the roller reel 34 is nearly the same throughout the length of the roller reel.

Figure 12:
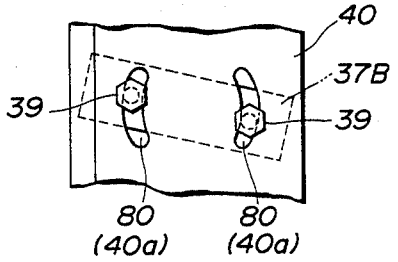
FIG. 12 is fragmentary bottom plan view of an essential part of a fifth embodiment of the weft storage device according to the present invention.

FIG. 12 illustrates a fifth embodiment of the weft storage device 13 of the present invention which is similar to the embodiment of FIGS. 2 to 4 except for the shape of through-holes 40a of the bracket 40. In this embodiment, an arcuate adjustment through-hole 80 is used in place of the through-hole 40a of the embodiment of FIGS. 2 to 4. As shown, two arcuate adjustment through-holes 80 are symmetrically located for each support frame 37A, 37B, 37C, in which the two bolts 39 pass through the respective two adjustment through-holes 80 and are screwed in the support frame 40. Accordingly, adjustment of the inclination angle of each drive roller 35A, 35B, 35C relative to the axis of the rotatable shaft 22 is accomplished by fixing the corresponding support frame 37A, 37B, 37C in a predetermined position upon tighening the bolts 39 passed through the adjustment through-holes 80 of the bracket 40. Thus, the support frames 37A, 37B, 37C, the bolts 39, the bracket 40, the adjustment through-holes 80 and the like constitute a drive roller inclination angle adjusting device. In this embodiment, the term inclination angle of each roller means an inclination angle of the axis of each roller relative to the axis of the rotatable shaft 22 on a horizontal plane H (see FIG. 9) containing the axis of the rotatable shaft 22.

Since the distance or winding pitch P is determined by the inclination and the rotational speed of the rollers 35A, 35B, 35C, 49A, 49B, 49C, it P can be changed by changing the inclination of the support frame 37A, 37B, 37C relative to the bracket 40. More specifically, changing the distance P of the wound weft yarn 11 is carried out by moving the loosened bolts 39 within the arcuate adjustment through-holes 80 to select a desired inclination angle of each drive roller 35A, 35B, 35C and then by tighening the bolts 39. It will be understood that the three drive rollers 35A, 35B, 35C may not be the same in inclination angle relative to the bracket 40 or the axis of the rotatable shaft 22.

Figure 13:
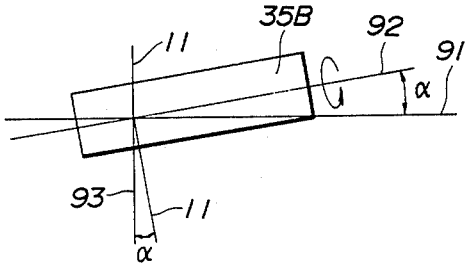
FIGS. 13, 14A, 14B, and 14C are schematic illustrations showing the effect of the inclination of rollers used in the weft storage device of FIG. 12.
Figure 14A:
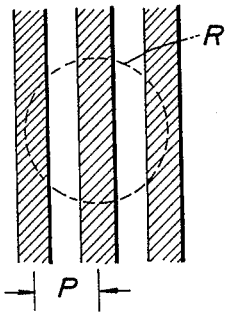
Figure 14B:
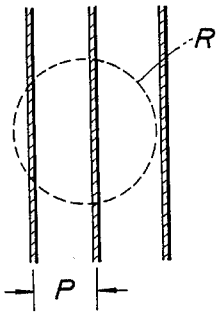
Figure 14C:
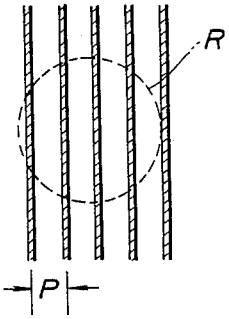

The effect of adjusting the inclination of the drive rollers 35A, 35B, 35C will be discussed with reference to FIG. 13 which is a Schematic illustration of the drive roller 35B as viewed from the direction of an arrow X in FIG. 3 common in this embodiment. In FIG. 13, the axis 92 of the drive roller 35B crosses the axis 91 (corresponding to the axis of the roller reel 34) of the rotatable shaft 22 at an angle $\alpha$. In this situation, the weft yarn 11 is wound from the direction perpendicular to the rotatable shaft axis 91 and fed in the direction perpendicular to the roller axis 92. In other words, the weft yarn 11 is fed to be shifted the angle $\alpha$ relative to an advancing direction line 93 of the weft yarn 11 and moved rightward in FIG. 13. This takes place for all the rollers 35A, 35B, 35C, 49A, 49B, 49C and therefore the weft yarn 11 can be wound on the roller reel 34 with an equal winding pitch P throughout whole the sections of the roller reel 34. It will be appreciated that the winding pitch P of the weft yarn wound on the roller reel 34 can be changed by suitably adjusting the above-mentioned angle $\alpha$. In this connection, in the case of using a thick weft yarn, the above-mentioned angle $\alpha$ is preferably enlarged thereby winding the weft yarn, for example, in a winding pitch P as shown in FIG. 14A. In contrast, in the case of using a thin weft yarn, the above-mentioned angle $\alpha$ is preferably minimized thereby to wind the weft yarn, for example, in a winding pitch P as shown in FIG. 14C. This is because, if the weft yarn (in the latter case) is wound in the same winding pitch as in the former case as shown in FIG. 14B, the sectional area of the weft yarn 11 occupies a very small part of a detection region R of the weft detector 67. While all the rollers 35A, 35B, 35C, 49A, 49B, 49C are arranged as being similarly inclined in the embodiment of FIG. 12, it will be appreciated that the follower rollers 49A, 49B, 49C may not be inclined.

Figure 15:
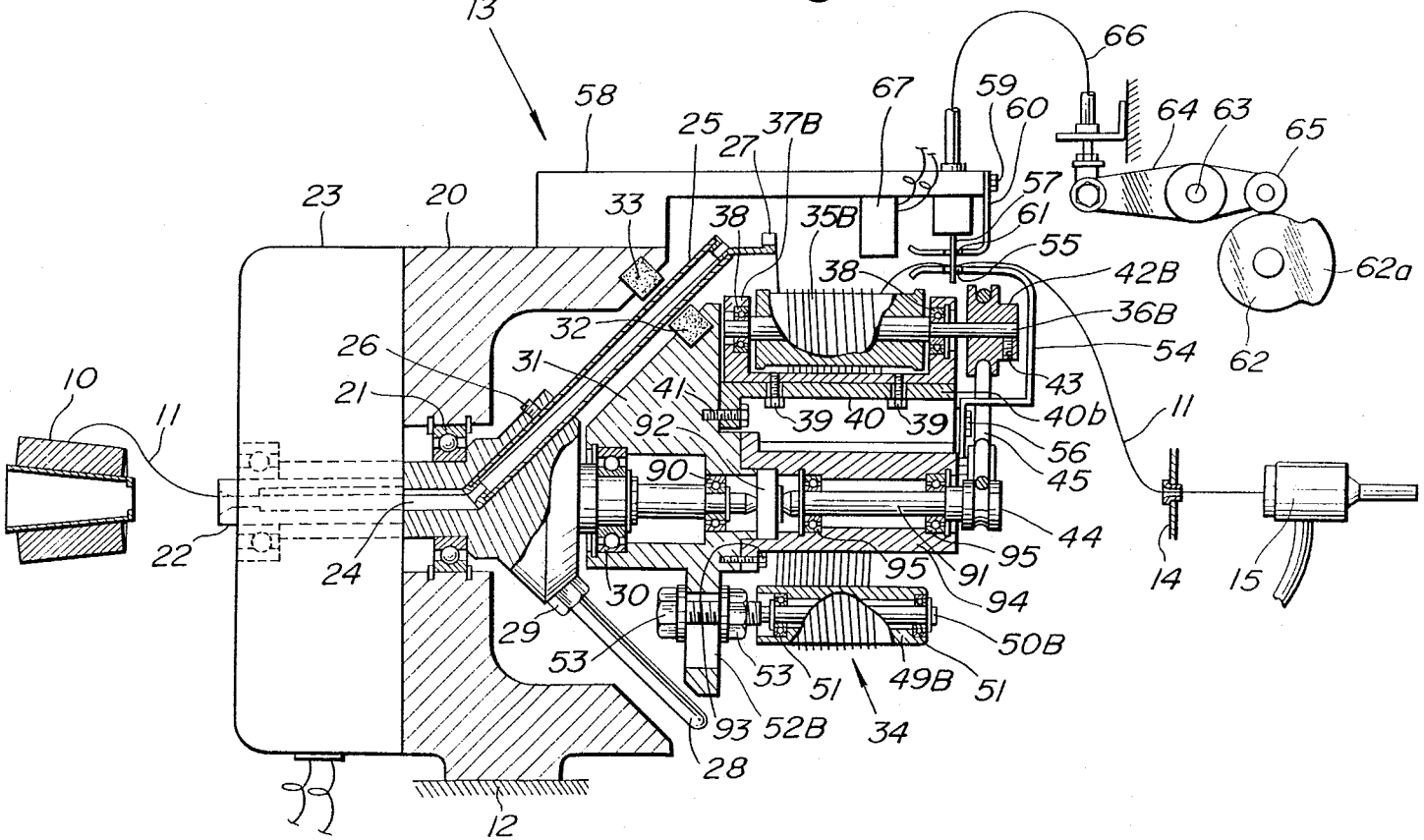
FIG. 15 is a front vertical sectional view similar to FIG. 2 but showing a sixth embodiment of the weft storage device according to the present invention.

FIG. 15 illustrates a sixth embodiment of the weft storage device 13 of the present invention which is similar to the embodiment of FIGS. 2 to 4 with the exception that the rotatable shaft 22 at a section on the weft inserting nozzle side is divided into two portions interposing therebetween a speed changer 92. In this embodiment, the flanged stationary support body 31 is relatively rotatably mounted through bearing 30 and a bearing 90 on the rotatable shaft 22 at the section on the side of the weft inserting nozzle 15. As shown, the input side rotatable shaft 22 is mechanically connected through the speed changer 92 to a separate output side rotatable shaft 91. This rotatable shaft 91 is formed at its tip portion with the pulley 44 on which the belt 45 is passed. The speed changer 92 is fixedly interposed between the cylindrical projected portion of the stationary support body 31 and the step-like portion of a cylindrical member 94 fixed to the stationary support body 31 by means of bolts 93. The rotatable shaft 91 is rotatably supported through bearings 95 on the inner peripheral surface of the cylindrical member 94.

Figure 16:
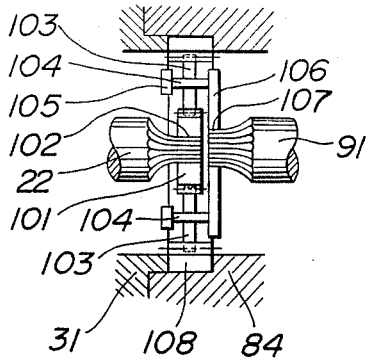
FIG. 16 is a sectional view of a speed changer used in the weft storage device of FIG. 15.
Figure 17:
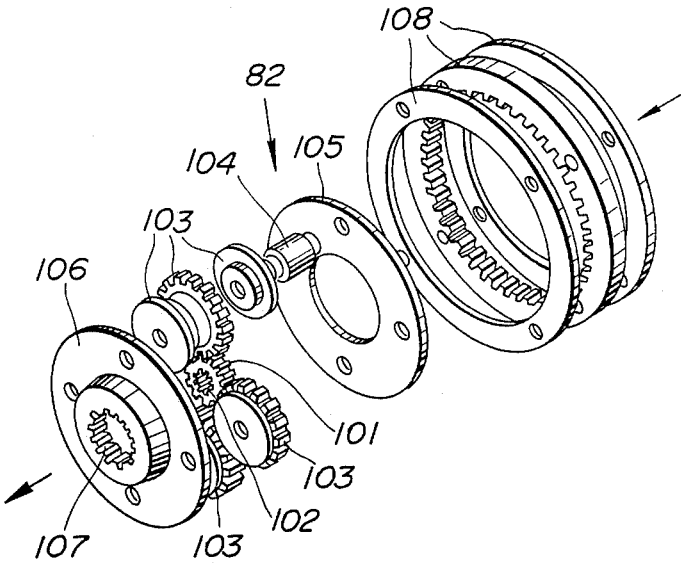
FIG. 17 is an perspective exploded view of the speed changer of FIG. 16.
Figure 18:
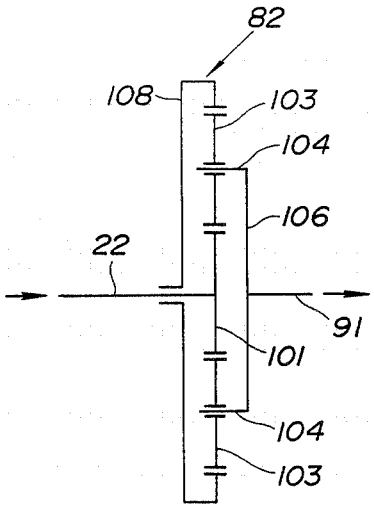
FIG. 18 is a diagrammatic illustration of the speed changer of FIG. 16.

The speed changer 92 will be discussed with reference to FIGS. 16, 17 and 18. The input side rotatable shaft 22 is formed at its tip end portion with splines engaged with splines formed at the inner periphery of a central hole 102 of a sun gear 101. The sun gear 101 is meshed with four planet gears 103 to each of which a spindle 104 loosely fits. The opposite end sections of the spindle 104 are respectively fixed to two oppositely spacedly disposed support plates 105, 106. The support plate 106 is formed with splines along the inner periphery of a central hole 107 which splines are engaged with splines formed at the end section of the output side rotatable shaft 91. All the planet gears 103 are meshed with an internal gear 108 which is maintained in a stationary state upon being securely put between the stationary support body 31 and the cylindrical member 94.

With this arrangement, the rotation of the input side rotatable shaft 22 is transmitted to the output side rotatable shaft 91 upon being changed by the speed changer 92. The rotation of the output side rotatable shaft 91 is transmitted through the pulley 44 and, the belt 45 to the drive rollers 35A, 35B, 35C thereby to rotate the drive rollers in the direction of the arrow B in FIG. 3 common in this embodiment. Since the speed changer 92 can be schematically illustrated as shown in FIG. 18, the reduction gear ratio is 1/(1+the number of teeth of the internal gear/the number of teeth of the sun gear). It will be understood that the winding pitch P of the weft yarn 11 wound on the rollers 35A, 35B, 35C, 49A, 49B, 49C is determined by the inclination and the rotational speed of the rollers. Accordingly, in order to change the winding pitch P, it is sufficient that the speed changer 92 is replaced with the other one whose number of the teeth of the internal gear 108 and the sun gear 104 is different from of the former speed changer 92 thereby to change the rotational speed of the rollers. It will be appreciated that the replacement of the speed changer 92 can be readily carried out merely by detaching the cylindrical member 94 upon removing the bolts 93.

Figure 19:
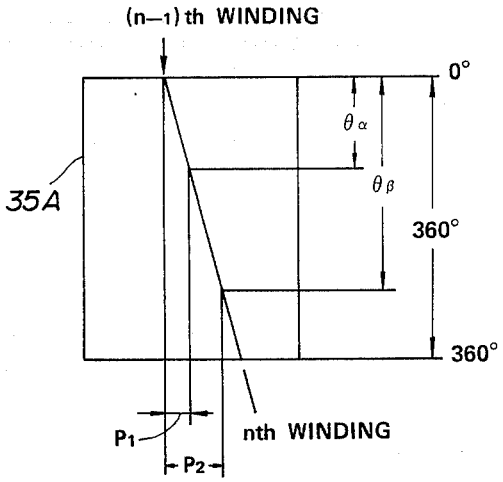
FIG. 19 is a graph illustrating the effect of replacement of the speed changer of FIG. 16.

The effect obtained by replacing the speed changer 92 will be discussed with reference to FIG. 19. Assuming that the winding guide 27 has a constant rotational speed, the rotational speed of the drive rollers 35A, 35B, 35C bears a greater meaning regarding the winding pitch P of the weft yarn 11 wound on the roller reel 34. That is to say, the winding pitch P is varied in accordance with the magnitude of the rotational movement (angle), for example, of the roller 35A for a time duration from a first point of time at which (n−1)th winding is made to a second point of time at which nth winding is made. It will be understood that the above-mentioned rotational movement (angle) decreases as the reduction gear ratio increases. Accordingly, in the case where the above-mentioned rotational movement corresponds to an angle $\theta_\alpha$ upon the reduction gear ratio being greater, the winding pitch P between the thread lines of the weft yarn 11 wound on the rollers becomes $P_1$ as shown in FIG. 19. In contrast, in the case where the above-mentioned rotational movement corresponds to angle $\theta_\beta$ upon reduction gear ratio being smaller the winding pitch P becomes $P_2$. Thus, the above-discussed arrangement of FIGS. 15, 16, 17 and 18 enables free selection of the winding pitch P of the wound weft yarn, so that the winding pitch can become suitable for the kind of the weft yarn to be used. While all the rollers 35A, 35B, 35C, 49A, 49B, 49C are arranged as being inclined in the embodiment of FIGS. 15 to 18, it will be appreciated that the follower rollers 49A, 49B, 49C may not be inclined relative to the axis of the rotatable shafts 22, 91.

While the various embodiments discussed hereinbefore have been shown and described as being so arranged that the weft yarn 11 is wound on the roller reel 34 in such a manner as to always maintain a predetermined amount or more of the weft yarn upon detecting the weft yarn amount on the roller reel 34, it will be understood that the weft yarn 11 may be wound in an amount of one pick per one rotation of the loom main shaft by making an integer number of rotations of the winder pipe 25 per one rotation of the loom main shaft in timed relation to the loom main shaft.

Furthermore, although the hereinbefore discussed embodiments have been shown and described as being so configurated that the winder pipe 25 revolves the roller reel 34 maintained in a stationary state thereby to wind the weft yarn 11 on the roller reel 34, it will be appreciated that the winding operation of the weft yarn 11 may be accomplished by causing the roller reel 34 to rotate and by fixing the winder pipe 25 at a certain position, in which the engaging member 57 may be movably disposed inside the roller reel 34 in such a manner as to project over and withdraw below the outer peripheral surface of the roller reel 34.

It is understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions, and all changes or variations which fall within the meaning and range of the claims are therefore intended to be embraced therein.

What is claimed is:

1. A method for storing a weft yarn between weft supply means and a weft inserting nozzle in a fluid jet loom, said method comprising:

winding said weft yarn on a roller reel in a coil shape prior to introduction to said weft inserting nozzle, said roller reel including a plurality of rollers arranged to be nearly circular and nearly parallel with each other, an axis of at least one of said rollers being outside any of planes containing an axis of said roller reel, said rollers including at least one driving roller which is fixed in location in said roller reel, and follower rollers which are changeable in location in said roller reel;

feeding said weft yarn on said roller reel toward a first end section of said roller reel by driving said driving roller to rotate around an axis of said driving roller and by sliding said weft yarn axially along smooth surfaces provided on said rollers, in which said follower rollers rotate with said driving roller through said weft yarn fed on said driving roller and said follower rollers, said first end section being located on side of said weft inserting nozzle; and driving an engaging member to engage with said weft yarn and to disengage from said weft yarn during weft picking, said engaging member movably disposed in the vicinity of said first end section of said roller reel and disposed adjacent said driving roller.

2. A method as claimed in claim 1, further comprising the steps of:

feeding weft yarn on said roller reel by rotating a weft guide member around said roller reel to wind said weft yarn on said roller reel; and during said feeding step, changing a ratio in rotational speed between said weft guide member and said at least one roller.

3. A weft storage device of a fluid jet loom, disposed between weft supply means and a weft inserting nozzle, said weft storage device comprising:

a roller reel on which said weft yarn is wound in a coil shape prior to introduction to said weft inserting nozzle, said roller reel including a plurality of rollers arranged to be nearly circular and nearly parallel with each other, an axis of at least one of said rollers being outside any of planes containing an axis of said roller reel, said rollers having smooth surface means for allowing said weft yarn to slide axially along said rollers, said rollers including at least one driving roller, and follower rollers;

means for driving said driving roller to rotate around an axis thereof;

means for allowing said follower rollers to rotate with rotation of said driving roller through said weft yarn wound on said driving roller and said follower rollers;

means for fixing location of said driving roller in said roller reel;

means for changing location of said follower rollers in said roller reel;

a movable engaging member disposed adjacent a first end section of said roller reel to be engageable with said weft yarn to be introduced into said weft inserting nozzle, said first end section being located on side of said weft inserting nozzle said movable engaging member being disposed adjacent said driving roller; and driving means for moving said engaging member to disengage from said weft yarn during weft picking.

4. A weft storage device as claimed in claim 3, further comprising means for adjusting a circumferential length of said roller reel, said circumferential length adjusting means including means for adjusting a radial distance of at least one of said rollers from said roller reel axis.

5. A weft storage device as claimed in claim 4, further comprising means for gradually decreasing a circumferential length of at least a longitudinal part of said roller reel in a direction toward said weft inserting nozzle, said circumferential length decreasing means including means for inclining at least a longitudinal part of outer surface of at least one of said rollers to be closer to said roller reel axis in the direction toward said weft inserting nozzle on a vertical plane containing said roller reel axis.

6. A weft storage device as claimed in claim 4, further comprising means for adjusting an inclination angle of the axis of at least one of said rollers relative to said roller reel axis on a horizontal plane containing said roller reel axis.

7. A weft storage device as claimed in claim 4, further comprising a weft guide member through which said weft yarn is fed on said roller reel, said weft guide member being rotatable around said roller reel to wind said weft yarn on said roller reel, and means for changing a ratio in rotational speed between said weft guide member and said at least one roller.

8. A weft storage device as claimed in claim 3, further comprising means for gradually decreasing a circumferential length of at least a longitudinal part of said roller reel in a direction toward said weft inserting nozzle, said circumferential length decreasing means including means for inclining at least a longitudinal part of outer surface of at least one of said rollers to be closer to the roller reel axis in the direction toward said weft inserting nozzle on a vertical plane containing said roller reel axis.

9. A weft storage device as claimed in claim 8, further comprising means for adjusting an inclination angle of the axis of at least one of said rollers relative to said roller reel axis on a horizontal plane containing said roller reel axis.

10. A weft storage device as claimed in claim 8, further comprising a weft guide member through which said weft yarn is fed on said roller reel, said weft guide member being rotatable around said roller reel to wind said weft yarn on said roller reel, and means for changing a ratio in rotational speed between said weft guide member and said at least one roller.

11. A weft storage device as claimed in claim 3, further comprising means for adjusting an inclination angle of the axis of at least one of said rollers relative to said roller reel axis on a horizontal plane containing said roller reel axis.

12. A weft storage device as claimed in claim 3, further comprising a rotatable shaft rotatably and driveably supported on a fixed support body, said rollers of said roller reel being located around said rotatable shaft, an axis of said rotatable shaft serving as said axis of said roller reel, axis of each roller extending nearly along said axis of said rotatable shaft, a stationary support body on which said rollers are rotatably supported, said stationary support body being rotatably mounted on said rotatable shaft and maintained substantially stationary, means for transmitting a rotational force of said rotatable shaft to said at least one roller, and a weft guide member rotatable together with said rotatable shaft and around said roller reel to wind said weft yarn on said roller reel.

13. A weft storage device as claimed in claim 3, wherein said follower roller location fixing means includes means for fixing the axis of said driving roller.

14. A weft storage device as claimed in claim 3, wherein said follower rollers location changing means includes means for moving location of an axis of each follower roller.

15. A weft storage device of a fluid jet loom, disposed between weft supply means and a weft inserting nozzle, said weft storage device comprising:

a roller reel on which said weft yarn is wound in a coil shape prior to introduction to said weft inserting nozzle, said roller reel including a plurality of rollers arranged to be nearly circular and nearly parallel with each other, an axis of at least one of said rollers being outside any of planes containing an axis of said roller reel, said rollers including at least one driving roller, and follower rollers;

means for driving said driving roller to rotate around an axis thereof;

means for allowing said follower rollers to rotate with rotation of said driving roller through said weft yarn wound on said driving roller and said follower rollers;

means for fixing location of said driving roller in said roller reel;

means for changing location of said follower rollers in said roller reel;

an engaging member movably disposed in the vicinity of a first end section of said roller reel to be engageable with said weft yarn to be introduced into said weft inserting nozzle, said first end section being located on side of said weft inserting nozzle, said movable engaging member being disposed adjacent said driving roller;

means for driving said engaging member to disengage from said weft yarn during weft picking; and a weft guide member through which has weft yarn is fed on said roller reel, said weft guide member being rotatable around said roller reel to wind said weft yarn on said roller reel, and means for changing a ratio in rotational speed between said weft guide member and said at least one roller.

16. A weft storage device of a fluid jet loom, disposed between weft supply means and a weft inserting nozzle, said weft storage device comprising:

a roller reel on which said weft yarn is wound in a coil shape prior to introduction to said weft inserting nozzle, said roller reel including a plurality of rollers arranged to be nearly circular and nearly parallel with each other, an axis of at least one of said rollers being outside any of planes containing an axis of said roller reel;

means for driving said at least one roller to rotate around an axis thereof;

an engaging member movably disposed in the vicinity of a first end section of said roller reel to be engageable with said weft yarn to be introduced into said weft inserting nozzle, said first end section being located on side of said weft inserting nozzle;

means for driving said engaging member to disengage from said weft yarn during weft picking; and a rotatable shaft rotatably and driveably supported on a fixed support body, said rollers of said roller reel being located around said rotatable shaft, an axis of said rotatable shaft serving as said axis of said roller reel, axis of each roller extending nearly along said axis of said rotatable shaft, a stationary support body on which said rollers are rotatably supported, said stationary support body being rotatably mounted on said rotatable shaft and maintained substantially stationary, means for transmitting a rotational force of said rotatable shaft to said at least one roller, and a weft guide member rotatable together with said rotatable shaft and around said roller reel to wind said weft yarn on said roller reel;

said rollers of said roller reel including a plurality of drive rollers driven by said rotatable shaft, and a plurality of follower rollers rotatable through said weft yarn passed on said drive and follower rollers;

said rotatable shaft allowing for said follower rollers to rotate with rotation of said drive rollers, for fixing location of said drive rollers in said roller reel, and for changing location of said follower rollers in said roller reel; and said movable engaging member being disposed adjacent said drive rollers. said weft yarn on said roller reel.

17. A weft storage device as claimed in claim 16, wherein said driving means is arranged to drive a plurality of drive pulleys to rotate, said driving means including a first pulley coaxially and securely connected to each drive roller, a second pulley coaxially and securely connected to said rotatable shaft, and a belt passes on said first and second pulleys.

18. A weft storage device as claimed in claim 16, further comprising first and second plate members disposed in the vicinity of said roller reel first end and spaced from each other so that said weft yarn lies therebetween, said first and second plate members being formed respectively with first and second through-holes into which said engaging member is insertable to engage with said weft yarn.

19. A weft storage device as claimed in claim 18, wherein said driving means for moving said engaging member includes a drive mechanism constructed and arranged to drive said engaging member to withdraw from said first and second through-holes in timed relation to operation of the loom.

20. A weft storage device as claimed in claim 16, wherein each follower roller includes a cylindrical roller member, and a spindle on which said roller member is rotatably mounted.

21. A weft storage device as claimed in claim 20, wherein said circumferential length adjusting means includes means defining an elongate hole in said stationary support body, said elongate hole elongating radially relative to said rotatable shaft axis, an end section of said spindle being securably disposed in said elongate hole.

22. A weft storage device as claimed in claim 16, further comprising means for gradually decreasing a circumferential length of at least a part of said roller reel in a direction toward said weft inserting nozzle.

23. A weft storage device as claimed in claim 22, said circumferential length decreasing means includes means for inclining the axis of at least one of said rollers to be closer to said rotatable shaft axis on a vertical plane containing said rotatable shaft axis.

24. A weft storage device as claimed in claim 23, wherein said roller reel includes a bracket fixed to said stationary support body and formed with a plate section on which said drive rollers are rotatably supported, said plate section being inclined in such a manner that the axis of each drive rollers is inclined to be closer to the rotatable shaft axis in the direction toward said weft inserting device on said vertical plane.

25. A weft storage device as claimed in claim 22, wherein at least a longitudinal part of each drive roller is tapered in the direction toward said weft inserting nozzle on said vertical plane.

26. A weft storage device as claimed in claim 16, further comprising means for adjusting an inclination angle of the axis of at least one of said rollers relative to said roller reel axis on a horizontal plane containing said rotatable shaft axis.

27. A weft storage device as claimed in claim 26, wherein said roller reel includes a bracket fixed to said stationary support body and formed with a plate section generally extending along said rotatable shaft, and a roller support member on which each drive roller is rotatable supported, said roller support member being fixable to said bracket.

28. A weft storage device as claimed in claim 27, wherein said inclination angle adjusting means includes means for adjusting the inclination of said roller support member relative to said bracket.

29. A weft storage device as claimed in claim 28, wherein said inclination adjusting means includes means defining first and second arcuate through-holes in said bracket, said first and second arcuate through-holes being arranged along said rotatable shaft and located symmetrical with each other, and first and second bolts passed through said respective through-holes and screwed into said roller support member.

30. A weft storage device as claimed in claim 16, further comprising means for changing a ratio in rotational speed between said weft guide member and said drive rollers.

31. A weft storage device as claimed in claim 30, wherein said rotatable shaft includes first and second shaft sections which aligned with each other, said first shaft section being driven by an electric motor, said stationary support body being rotatably mounted on said first shaft section, said second shaft section being rotatably supported relative to said stationary support body and driveably connected to said drive rollers through said rotational force transmitting means, in which said rotational speed changing means includes a speed changer unit through which said first and second shaft sections are mechanically connected with each other, and means for causing said speed changer unit to be detachable.

32. A weft storage device as claimed in claim 31, wherein said causing means includes a cylindrical member securable to said stationary support body, said second shaft section of said rotatable shaft being rotatably disposed within said cylindrical member, said speed changer unit being securable between said cylindrical member and said stationary support member.

33. A weft storage device as claimed in claim 31, wherein said speed changer unit includes a sun gear fixedly mounted on said first shaft section, a plurality of planet gears engaged with said sun gear, a support plate fixedly mounted on said second shaft section and rotatably carrying said planet gears thereon.

* * * * *